United States Patent [19]

Ikeda et al.

[11] Patent Number: 4,837,197

[45] **Date of Patent: * Jun. 6, 1989**

[54] HEAT-SENSITIVE RECORDING MATERIAL

[75] Inventors: Haruhiko Ikeda; Masahiro Higuchi; Hirokazu Ohkura, all of Tokyo, Japan

[73] Assignee: Mitsubishi Paper Mills, Ltd., Tokyo, Japan

[ * ] Notice: The portion of the term of this patent subsequent to Aug. 16, 2005 has been disclaimed.

[21] Appl. No.: 137,679

[22] Filed: Dec. 24, 1987

[30] Foreign Application Priority Data

| | | | |
|---|---|---|---|
| Dec. 25, 1986 | [JP] | Japan | 61-310728 |
| Dec. 25, 1986 | [JP] | Japan | 61-310733 |
| Apr. 6, 1987 | [JP] | Japan | 62-85424 |

[51] Int. Cl.[4] ..... B41M 5/18

[52] U.S. Cl. ..... 503/209; 427/150; 427/151; 428/913; 428/914; 503/208

[58] Field of Search ..... 427/150–152; 428/195, 913, 914; 503/208, 209

[56] References Cited

U.S. PATENT DOCUMENTS

| | | | |
|---|---|---|---|
| 4,269,893 | 5/1981 | Kato et al. | 503/225 |
| 4,538,164 | 8/1985 | Takigawa et al. | 503/209 |
| 4,707,463 | 11/1987 | Ikeda et al. | 503/208 |
| 4,764,501 | 8/1988 | Ikeda et al. | 503/209 |

FOREIGN PATENT DOCUMENTS

| | | | |
|---|---|---|---|
| 0151394 | 9/1982 | Japan | 503/225 |
| 0224786 | 12/1983 | Japan | 503/208 |
| 0214689 | 12/1984 | Japan | 503/209 |

*Primary Examiner*—Bruce H. Hess

*Attorney, Agent, or Firm*—Cushman, Darby & Cushman

[57] ABSTRACT

A heat-sensitive recording material containing a special sensitizer in a heat-sensitive recording layer formed on a support is excellent in thermal response.

8 Claims, No Drawings

HEAT-SENSITIVE RECORDING MATERIAL

BACKGROUND OF THE INVENTION

This invention relates to a heat-sensitive recording material excellent in thermal response.

Heat-sensitive recording materials generally comprise a support and formed thereon a heat-sensitive recording layer containing an electron donative, normally colorless or light-colored dye precursor and an electron-accepting color developer. When heated with a thermal head, a thermal pen, a laser light, or the like, the dye precursor and the color developer react instantly to give a recording image. These heat-sensitive recording materials are disclosed, for example, in Japanese Patent Examined Publication Nos. 43-4160 and 45-14039. Since these heat-sensitive recording materials have advantages in that recording can be obtained by using a relatively simple apparatus, maintenance is easy and no noise is generated, these materials are widely used in the fields of measuring instrument recorders, facsimile machines, printers, computer terminals, labels, automatic ticket vending machines, etc. Particularly in the field of facsimile machines, a demand for heat-sensitive method increases remarkably and high-speed transmission is to be realized in order to reduce a transmitting cost. In response to speed-up of facsimile machines, a demand for more sensitive heat-sensitive recording materials increases. For example, since a high-speed facsimile machine can send and receive a message of a standard A4 size manuscript in several seconds to 20 seconds, an electric current passing through a thermal head of the facsimile machine is repetition of a very short time of several milliseconds or less and a heat energy generated thereby transmits to a heat-sensitive recording sheet to carry out an image formation reaction.

In order to carry out the image formation reaction by the thermal energy transmitted in such a short time, it is necessary to make heat-sensitive recording materials excellent in thermal response. In order to increase the thermal response, it is necessary to improve compatibility of the color developer with the dye precursor. For such a purpose, a sensitizer is used, if necessary. Since the sensitizer has a function to accelerate a color forming reaction by dissolving or involving the neighboring dye precursor and color developer when it melts by the transmitted heat energy, it is one method for making the sensitivity of heat-sensitive recording material higher to improve the thermal response of the sensitizer. Such a method can be attained by adding, for example, waxes (Japanese Patent Unexamined Publication No. 48-19231), nitrogen-containing compounds and carboxylic acid esters (Japanese Patent Unexamined Publication Nos. 49-34842, 50-149353, 52-106746, and 53-5636), naphthol derivatives (Japanese Patent Unexamined Publication Nos. 57-64593 and 58-87094), naphthoic acid derivatives (Japanese Patent Unexamined Publication Nos. 57-64592, 57-185187, 57-191089 and 58-110289), benzoic acid ester derivatives (Japanese Patent Unexamined Publication Nos. 57-148688, 57-182483, 58-112788, and 58-162379), para-benzylbiphenyl (Japanese Patent Unexamined Publication No. 60-122193), biphenyls (Japanese Patent Unexamined Publication No. 61-272189), diphenoxyethanes (Japanese Patent Unexamined Publication No. 60-56588) and sulfides (Japanese Patent Unexamined Publication No. 61-242884). But heat-sensitive recording materials produced by such methods are still insufficient in developed color density and optical density.

SUMMARY OF THE INVENTION

It is an object of this invention to provide a highly sensitive heat-sensitive recording material more excellent in thermal response.

This invention provides a heat-sensitive recording material comprising a support and formed thereon a heat-sensitive recording layer comprising a normally colorless or light-colored dye precursor, a color developer which forms a color by reacting with the dye precursor when heated, and a sensitizer represented by the formula:

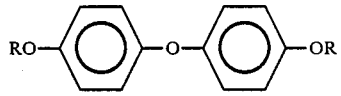

(1)

wherein R is an alkenyl group, an alkenylcarbonyl group, an alkanesulfonyl group, an aroyl group, an aralkyl group, or a group of the formula:

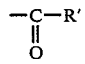

in which R′ is a lower alkyl group.

DESCRIPTION OF THE PREFERRED EMBODIMENTS

This invention is characterized by using a special sensitizer in the heat-sensitive recording layer. The sensitizer is represented by the formula:

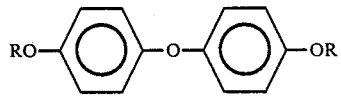

(1)

wherein R is an alkenyl group having preferably 2 to 4 carbon atoms, e.g. an allyl group; an alkenylcarbonyl group such as an acryloyl group, a methacryloyl group, etc.; an alkanesulfonyl group such as a methanesulfonyl group, an ethanesulfonyl group, etc.; an aroyl group or an aralkyl group such as a benzoyl group, a benzyl group, etc.; or a group of the formula:

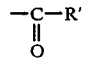

in which R′ is a lower alkyl group, preferably having 1 to 4 carbon atoms, e.g. an acetyl group, a propionyl group, etc.

Preferable examples of the sensitizer of the formula (1) are as follows:

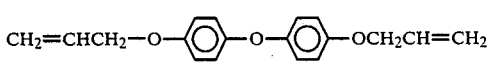

(2)

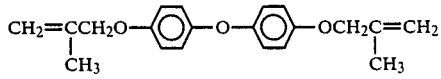

(3)

-continued (4)

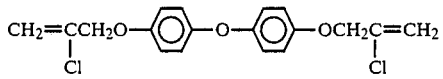

(5)

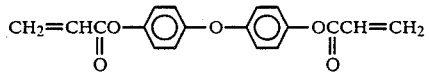

(6)

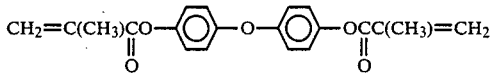

(7)

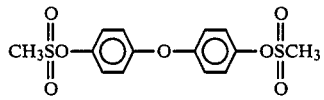

(8)

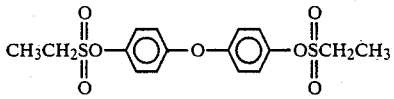

(9)

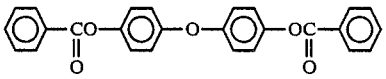

(10)

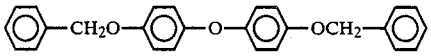

(11)

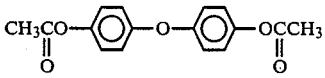

(12)

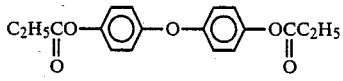

The compounds of the formula (1) can be produced by conventional processes.

The sensitizer of the formula (1) is usually used in an amount of 5% by weight or more, preferably 10 to 400% by weight, more preferably 20 to 300% by weight. When the adding amount is less than 5% by weight, the effect for improving the sensitivity is insufficient. On the other hand, when the adding amount is more than 400% by weight, it is disadvantageous economically and a sufficient developed color density cannot be obtained due to a dilution effect of a large amount of the heat meltable substance.

In the heat-sensitive recording layer, the following major components can be used, but not limited thereto.

As the dye precursor, there can be used triphenylmethane series, fluoran series, diphenylmethane series, thiazine series and spiropyrane series compounds.

Examples of the dye precursor are: 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide,
3-diethylamino-6-methyl-7-chlorofluoran,
3-diethylamino-7-chlorofluoran,
3-diethylamino-6-chloro-7-methylfluoran,
3-diethylamino-7-anilinofluoran,
3-diethylamino-6-methyl-7-dibenzylaminofluoran,
3-(N-ethyl-N-p-toluidino)-7-anilinofluoran,
3-diethylamino-7-(O-chloroanilino)fluoran,
3-dibutylamino-7-(O-chloroanilino)fluoran,
3-diethylamino-6-methyl-7-anilinofluoran,
3-(N-ethyl-N-p-toluidino)-6-methyl-7-anilinofluoran,
3-(N-methyl-N-cyclohexylamino)-6-methyl-7-anilinofluoran,
3-piperidino-6-methyl-7-anilinofluoran,
3-pyrrolidino-6-methyl-7-anilinofluoran,
3-diethylamino-7-(m-trifluoromethylanilino)fluoran,
3-(N-ethyl-N-isopentylamino)-6-methyl-7-anilinofluoran,
3-diethylamino-6-methyl-7-(p-phenetidino)fluoran,
3-dibutylamino-7-(O-fluoroanilino)fluoran,
3-dibutylamino-6-methyl-7-anilinofluoran, etc.

As the color developer, there can be used acidic substances generally used in heat-sensitive paper, that is, electron-accepting compounds such as phenol derivatives, aromatic carboxylic acid derivatives, N,N'-diarylthiourea derivatives, polyvalent metal (e.g. Zn) compounds, etc.

Particularly preferable color developers are bisphenols among the phenol derivatives in which one hydroxyl group may be substituted and represented by the formula:

(13)

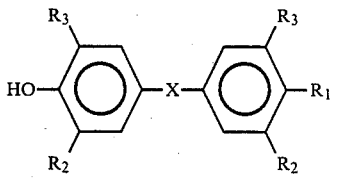

wherein X is

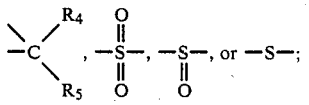

$R_1$ is a hydroxyl group, a lower alkoxy group preferably having 1 to 4 carbon atom, a lower alkyl group preferably having 1 to 4 carbon atoms or a halogen atom; $R_2$ and $R_3$ are independently hydrogen, a lower alkyl group preferably having 1 to 4 carbon atoms, a lower alkenyl group preferably having 2 to 4 carbon atoms, or a halogen atom; $R_4$ and $R_5$ are independently hydrogen, a lower alkyl group preferably having 1 to 4 carbon atoms or a lower alkoxycarbonyl group, or $R_4$ and $R_5$ may combine to form a ring.

Examples of the compound of the formula (13) are:
2,2-bis(4-hydroxyphenyl)propane,
2,2-bis(4-hydroxyphenyl)butane,
1,1-bis(4-hydroxyphenyl)cyclohexane,
2,2-bis(4-hydroxyphenyl)pentane,
2,2-bis(4-hydroxyphenyl)hexane,
methyl 2,2-bis(4-hydroxyphenyl)acetate,
ethyl 2,2-bis(4-hydroxyphenyl)acetate,
butyl 2,2-bis(4-hydroxyphenyl)acetate.
bis(4-hydroxyphenyl)sulfone,
bis(4-hydroxyphenyl)sulfoxide,
bis(4-hydroxyphenyl)sulfide,
4-hydroxy-4'-isopropyloxydiphenylsulfone,
4-hydroxy-4'-methyldiphenylsufone,
4-hydroxy-4'-chlorodiphenylsulfone,
2,2-bis(3-t-butyl-4-hydroxyphenyl)propane,
2,2-bis(3-chloro-4-hydroxyphenyl)propane,
bis(3-allyl-4-hydroxyphenyl)sulfone,
bis(3-t-butyl-4-hydroxy-5-methylphenyl)sulfide,
4-hydroxydiphenylsulfone, etc.

Other preferable color developers are:
benzyl 4-hydroxybenzoate,
1,7-bis(4-hydroxyphenylthio)-3,5-dioxaheptane,
N,N'-bis(3-chlorophenyl)thiourea,
zinc thiocyanate,
N,N'-bis(3-trifluoromethylphenyl)thiourea,
lauryl gallate,
stearyl gallate,
behenyl gallate,
zinc hydroxynaphthoate,
salicylic anilide,
dimethyl 4-hydroxyphthalate,
a metal (e.g. Zn) salt of 5-t-butylsalicylic acid,
dimethyl 6-hydroxy-2,3-naphthalenedicarboxylate,
methyl 4-hydroxybenzoate,
4-hydroxybenzoic acid,
benzyl 2,4-dihydroxybenzoate,
benzyl 3,4-dihydroxybenzoate,
4-t-butylzenzoic acid,
5-chlorosalicylic anilide,
isopropyl 4-hydroxybenzoic acid,
2-phenoxyethyl 4-hydroxybenzoate,
benzoic acid,
novolak type phenol resin,
2,2'-dihydroxybiphenyl,
1-naphthol,
2-naphthol,
bis(2-hydroxy-5-chlorophenyl)methane,
1,1-bis(2-hydroxy-5-methylphenyl)dodecane,
4-phenylphenol,
4-t-butylphenol,
phenol,

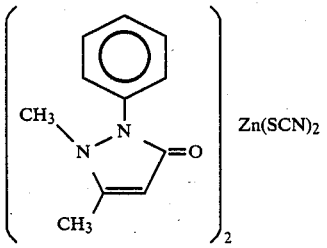

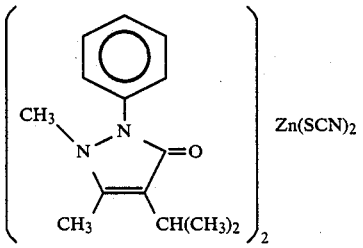

1,5-bis(3-hydroxyphenoxy)pentane,
1,2-bis(3-hydroxyphenoxy)ethane,
1,2-bis(4-hydroxyphenoxy)ethane,
1-(2,4-dihydroxyphenyl)-1-phenylethane,
stearyl 4-hydroxybenzoate,
1,1-bis(4-hydroxyphenyl)-1-phenylethane,

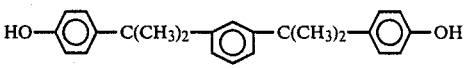

3-(2-phenoxyethoxy)phenol,
3,4-dihydroxy-4'-methyldiphenylsulfone, etc.

As a (non-wax) binder, there can be used water-soluble binders such as starches, hydroxy cellulose, methyl cellulose, carboxymethyl cellulose, gelatin, casein, polyvinyl alcohol, modified polyvinyl alcohol, styrene-maleic anhydride copolymer, ethylene-maleic anhydride copolymer, etc.; latex type water-soluble binders such as styrene-butadiene copolymer, acrylonitrile-butadiene copolymer, methyl acrylate-butadiene copolymer, etc.

As pigments, there can be used inorganic pigments such as diatomaceous earth, talc, kaolin, calcined kaolin, calcium carbonate, magnesium carbonate, titanium oxide, zinc oxide, silicon oxide, aluminum hydroxide, etc.; organic pigments such as urea-formaldehyde resin, etc.

The heat-sensitive recording layer may further contain one or more metal salts of higher fatty acids such as zinc stearate, calcium stearate, etc., and waxes much as paraffin, oxidized paraffin, polyethylene, oxidized polyethylene, stearamide, castor wax, etc. for preventing wearing of a thermal head or preventing sticking, etc.; dispersing agents such as sodium dioctylsuccinate; etc.; ultraviolet light absorbers of benzophenones, benzotriazoles, etc.; conventional surface active agents; and conventional fluorescent dyes, etc.

These dye precursors, color developers, sensitizers, and other additives mentioned above are formed into one or more dispersions and if necessary mixed, and coated on a support, followed by drying to give the heat-sensitive recording layer by a conventional process.

As the support, there can be used paper mainly, a coated paper forming a layer of pigments or the like thereon, various non-woven fabrics, plastic films, synthetic paper, metal foils, or composite sheets obtained by combining the above-mentioned materials, etc.

This invention is illustrated by way of the following Examples.

SYNTHESIS EXAMPLE 1

Synthesis of Compound (2)

In 90 ml of acetone, 9.1 g of 4,4'-dihydroxydiphenyl ether was dissolved. After adding 12.1 g of a 35.5% sodium hydroxide aqueous solution thereto, the resulting system was refluxed with stirring for 8 hours. Then, toluene and water were added thereto for separation. The organic layer was washed with an aqueous sodium bicarbonate solution, dried over anhydrous potassium carbonate, followed by removal of the solvent by distillation. The residue was treated with ethanol to yield crystals of the desired compound of the formula:

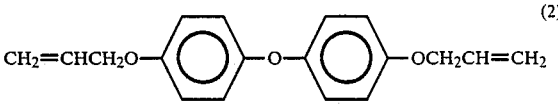

(2)

After recrystallization from ethanol, the compound of the formula (2) having a melting point of 80.0° to 81.5° C. was yielded in 7.1 g.

EXAMPLE 1

3-(N-Ethyl-N-isopentylamino)-6-methyl-7-anilinofluoran in an amount of 20 g and 80 g of a 1% polyvinyl alcohol aqueous solution were ball milled to give a dispersion. On the other hand, 50 g of 2,2-bis(4-hydroxyphenyl)propane and 200 g of a 1% polyvinyl alcohol aqueous solution were ball milled to give a dispersion. Further, 50 g of the compound of the formula (2) and 200 g of a 1% polyvinyl alcohol aqueous solution were ball milled to give a dispersion.

After mixing these three dispersions, 125 g of a 40% dispersion of calcium carbonate, 40 g of a 25% dispersion of zinc stearate and 300 g of a 10% polyvinyl alcohol aqueous solution were added in this order and stirred sufficiently to give a coating fluid. The coating fluid was coated on a base paper having a basis weight of 49 g/m$^2$ so as to make the coating weight 6 g/m$^2$ in dry solids content, and dried, followed by super calendar treatment to give a heat-sensitive recording material.

COMPARATIVE EXAMPLE 1

The process of Example 1 was repeated except for using 50 g of N-hydroxymethylstearamide in place of 50 g of the compound (2) to give a heat-sensitive recording material.

COMPARATIVE EXAMPLE 2

The process of Example 1 was repeated except for using 50 g of 2-benzyloxynaphthalene in place of 50 g of the compound (2) to give a heat-sensitive recording material.

EVALUATION

The heat-sensitive recording materials obtained in Example 1 and Comparative Examples 1 and 2 were subjected to printing using a facsimile machine (FACOM FAX-621C, a trade name, mfd. by Fujitsu, Ltd.). Optical densities of the obtained images were measured by using a Macbeth RD-514 densitometer.

The results are shown in Table 1.

TABLE 1

| Example No. | Optical density |
|---|---|
| Example 1 | 1.30 |
| Comparative Example 1 | 1.03 |
| Comparative Example 2 | 1.18 |

SYNTHESIS EXAMPLE 2

Synthesis of Compound (5)

To 200 ml of acetone, 20.2 g of 4,4'-dihydroxydiphenyl ether and 34.1 g of a 36.5% sodium hydroxide aqueous solution were added. To the resulting system, 22.2 g of acrylic acid chloride was added dropwise in 40 minutes with stirring. After stirring for additional 20 minutes, toluene and water were added thereto for separation. The organic layer was washed with a sodium bicarbonate aqueous solution and dried over anhydrous potassium carbonate. After removing the solvent by distillation, the residue was treated with n-hexane and benzene to give crystals of the desired compound of the formula:

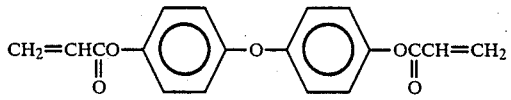

(5)

After recrystallization from a mixed solvent of n-hexane and benzene, the desired compound (5) having a melting point of 96.0 to 100.5° C. and mass spectrum (FD method) m/e=310 was obtained in yield of 15.9 g.

SYNTHESIS EXAMPLE 3

Synthesis of Compound (6)

The process of Synthesis Example 2 was repeated except for using 25.2 g of methacrylic acid chloride in place of 22.2 g of acrylic acid chloride to give the desired compound of the formula:

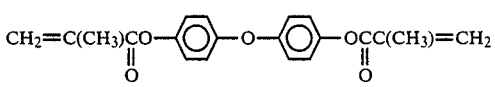

(6)

having a melting point of 89.5° to 92.0° C. and mass spectrum (FD method) m/e=338 in yield of 21.2 g.

SYNTHESIS EXAMPLE 4

Synthesis of Compound (7)

To 70 ml of acetone, 10.2 g of 4,4'-dihydroxydiphenyl ether and 18.2 g of a 36.6% sodium hydroxide aqueous solution were added, followed by dropwise addition of 14.0 g of methanesulfonic acid chloride with stirring in 20 minutes. After stirring for additional 40 minutes, ethyl acetate and water were added thereto for separation. The organic layer was washed with a sodium hydroxide aqueous solution and dried over anhydrous potassium carbonate. After removing the solvent by distillation, the residue was treated with benzene to give the desired compound of the formula:

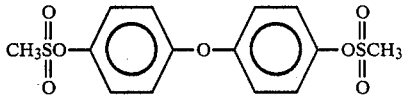

(7)

After recrystallization from benzene, the desired compound (7) having a melting point of 135.0° to 138.5° C. and mass spectrum (FD method) m/e=358 was yielded in 2.3 g.

SYNTHESIS EXAMPLE 5

Synthesis of Compound (8)

To 80 ml of acetone, 16.2 g of 4,4'-dihydroxydiphenyl ether and 36.0 g of a 29.2% sodium hydroxide aqueous solution were added. To this system, 25.2 g of ethanesulfonic acid chloride was added dropwise with stirring in 60 minutes. After stirring for additional 20 minutes, ethyl acetate and water were added for separation. The organic layer was washed with a sodium bicarbonate aqueous solution and dried over anhydrous potassium carbonate. The residue was treated with n-hexane and benzene to give the desired compound of the formula:

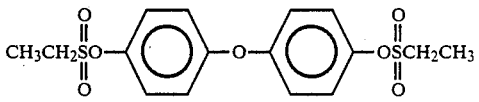

(8)

After recrystallization from a mixed solvent of n-hexane and benzene, the desired compound (8) having a melting point of 64.5° to 65.0° C. and mass spectrum (FD method) m/e=386 was obtained in yield of 7.1 g.

SYNTHESIS EXAMPLE 6

Synthesis of Compound (9)

In 200 ml of acetone, 16.2 g of 4,4'-dihydroxydiphenyl ether was dissolved. To this, a 50% sodium hydroxide aqueous solution was added and a white precipitate produced was filtered and dispersed in 300 ml of ethyl acetate. To this system, 23.9 g of benzoyl chloride was added dropwise with stirring while cooled with ice. After stirring for 24 hours, a precipitate was filtered, washed with a potassium carbonate aqueous solution, water and methanol in this order. After recrystallization from ethyl acetate, the desired compound of the formula:

(9)

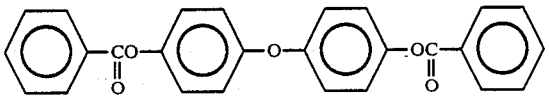

having a melting point of 144.0° to 145.0° C. and mass spectrum (FD method) m/e=410 was yielded in 9 g.

SYNTHESIS EXAMPLE 7

Synthesis of Compound (10)

To 70 ml of acetone, 10.1 g of 4,4'-dihydroxydiphenyl ether and 18.3 g of a 34.0% sodium hydroxide aqueous solution were added. After refluxing for 14 hours with stirring, ethyl acetate and water were added to the system for separation. The organic layer was washed with a sodium hydroxide aqueous solution and dried over anhydrous potassium carbonate. After removing the solvent by distillation, the residue was treated with ethanol and benzene to give crystals of the desired compound of the formula:

(10)

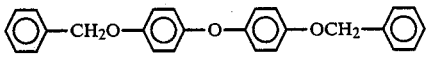

After recrystallization from a mixed solvent of ethanol and benzene, the desired compound (10) having a melting point of 146.5° to 149.5° C. and mass spectrum (FD method) m/e=382 was yielded in 2.9 g.

EXAMPLE 2

3-Diethylamino-6-methyl-7-anilinofluoran in an amount of 20 g and 80 g of a 1% polyvinyl alcohol aqueous solution were ball milled to give a dispersion. On the other hand, 50 g of 2,2-bis(4-hydroxyphenyl)-propane and 200 g of a 1% polyvinyl alcohol aqueous solution were ball milled to give a dispersion. Further, 50 g of the compound (5) and 200 g of a 1% polyvinyl alcohol aqueous solution were ball milled to give a dispersion.

After mixing these three dispersions, 125 g of a 40% dispersion of calcium carbonate, 40 g of a 25% dispersion of zinc stearate, and 300 g of a 10% polyvinyl alcohol aqueous solution were added thereto in this order with sufficient stirring to give a coating fluid. The coating fluid was coated on a base paper having a basis weight of 49 g/m$^2$ so as to make the coating weight 6 g/m$^2$ in dry solids content, and dried, followed by super calendar treatment to give a heat-sensitive recording material.

EXAMPLE 3

The process of Example 2 was repeated except for using 50 g of the compound (6) in place of the compound (5) to give a heat-sensitive recording material.

COMPARATIVE EXAMPLE 3

The process of Example 2 was repeated except for using 50 g of N-hydroxymethylstearamide in place of 50 g of the compound (5) to give a heat-sensitive recording material.

COMPARATIVE EXAMPLE 4

The process of Example 2 was repeated except for not using the dispersion of compound (5) to give a heat-sensitive recording material.

EVALUATION

The heat-sensitive recording materials obtained in Examples 2 and 3 and Comparative Examples 3 and 4 were subjected to printing using a heat-sensitive facsimile machine (mfd. by Matsushita Electronic Components Co., Ltd.) with applied pulse width of 1.2 msec. and applied voltage of 16.00 V. Optical densities of the obtained images were measured by using a Macbeth RD-514 densitometer.

The results are shown in Table 2.

TABLE 2

| Example No. | Optical density |
|---|---|
| Example 2 | 0.89 |
| Example 3 | 0.84 |
| Comparative Example 3 | 0.66 |
| Comparative Example 4 | 0.31 |

SYNTHESIS EXAMPLE 8

Synthesis of Compound (11)

In 50 ml of acetone, 10.1 g of 4,4'-dihydroxydiphenyl ether was dissolved and 17.5 g of a 36.0% sodium hydroxide aqueous solution was added thereto. To this system, 12.3 g of acetic anhydride was added dropwise with stirring in 5 minutes. After stirring for additional 4.5 hours, toluene and water were added to the system for separation. The organic layer was washed with a sodium bicarbonate aqueous solution and dried over anhydrous potassium carbonate. After removing the solvent by distillation, the residue was treated with a mixed solvent of n-hexane and benzene to give crystals of the desired compound of the formula:

(11)

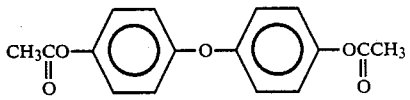

After recrystallization from a mixed solvent of n-hexane and benzene, the desired compound (11) having a melting point of 111.5° to 113.0° C. was obtained in 8.8 g.

EXAMPLE 4

3-(N-Ethyl-N-isopentylamino)-6-methyl-7-anilinofluoran in an amount of 20 g and 80 g of a 1% polyvinyl alcohol aqueous solution were ball milled to give a dispersion. On the other hand, 50 g of 2,2-bis(4-hydroxyphenyl)propane and 200 g of a 1% polyvinyl alcohol aqueous solution were ball milled to give a dispersion. Further, 50 g of the compound (11) and 200 g of a 1% polyvinyl alcohol aqueous solution were ball milled to give a dispersion.

After mixing these three dispersions, 125 g of a 40% dispersion of calcium carbonate, 40 g of a 25% dispersion of zinc stearate, and 300 g of a 10% polyvinyl alcohol aqueous solution were added in this order with sufficient stirring to give a coating fluid. The coating fluid was coated on a base paper having a basis weight of 49 g/m$^2$ so as to make the coating weight 6 g/m$^2$ in dry solids content and dried, followed by super calendar treatment to give a heat-sensitive recording material.

COMPARATIVE EXAMPLE 5

The process of Example 4 was repeated except for using 50 g of N-hydroxymethylstearamide in place of 50 g of the compound (11) to give a heat-sensitive recording material.

EVALUATION

The heat-sensitive recording materials obtained in Example 4 and Comparative Example 5 were subjected to printing using a facsimile machine (FACOM FAX-621C, a trade name, mfd. by Fujitsu, Ltd.). Optical densities of the obtained images were measured by using a Macbeth RD-514 densitometer.

The results are shown in Table 3.

TABLE 3

| Example No. | Optical density |
|---|---|
| Example 4 | 1.27 |
| Comparative Example 5 | 0.98 |

As shown in above Examples and Comparative Examples, there can be obtained high-sensitive heat-sensitive recording materials excellent in thermal response by using the special sensitizer.

What is claimed is:

1. A heat-sensitive recording material comprising a support and formed thereon a heat-sensitive recording layer comprising a normally colorless or light-colored dye precursor, a color developer which forms a color by reacting with the dye precursor when heated, and a sensitizer represented by the formula:

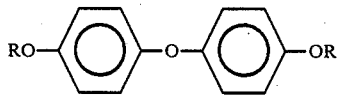

(1)

wherein R is an alkenyl group, an alkenylcarbonyl group, an alkanesulfonyl group, an aroyl group, an aralkyl group, or a group of the formula:

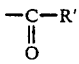

in which R′ is a lower alkyl group.

2. A heat-sensitive recording material according to claim 1, wherein the sensitizer is a compound of the formula:

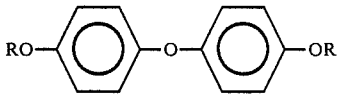

wherein R is an alkenyl group.

3. A heat-sensitive recording material according to claim 2, wherein the sensitizer is a compound of the formula:

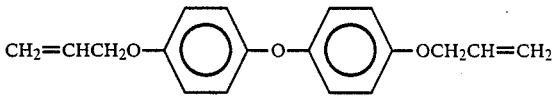

4. A heat-sensitive recording material according to claim 1, wherein the sensitizer is a compound of the formula:

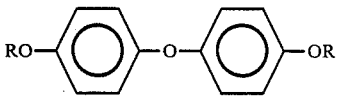

wherein R is an alkenylcarbonyl group, an alkanesulfonyl group, an aroyl group or an aralkyl group.

5. A heat-sensitive recording material according to claim 4, wherein the sensitizer is a compound of the formula:

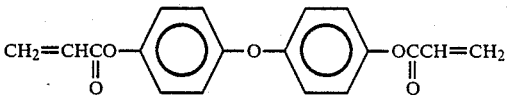

6. A heat-sensitive recording material according to claim 4, wherein the sensitizer is a compound of the formula:

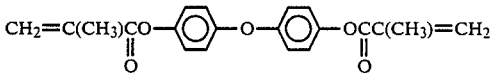

7. A heat-sensitive recording material according to claim 1, wherein the sensitizer is a compound of the formula:

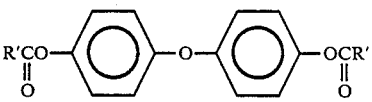

wherein R′ is a lower alkyl group.

8. A heat-sensitive recording material according to claim 7, wherein the sensitizer is a compound of the formula:

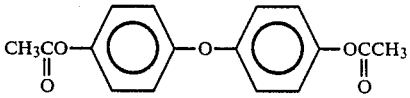

* * * * *